US008260592B2

(12) United States Patent
Schmitt et al.

(10) Patent No.: US 8,260,592 B2
(45) Date of Patent: Sep. 4, 2012

(54) METHOD TO PROVIDE A PROGNOSIS OF THE SURFACE TOPOGRAPHY OF TISSUE PAPER

(75) Inventors: Matthias Schmitt, München (DE); Stefan Schendzielorz, Ulm (DE)

(73) Assignee: Voith Patent GmbH, Heidenheim (DE)

( * ) Notice: Subject to any disclaimer, the term of this patent is extended or adjusted under 35 U.S.C. 154(b) by 538 days.

(21) Appl. No.: 12/556,641

(22) Filed: Sep. 10, 2009

(65) Prior Publication Data

US 2010/0070065 A1 Mar. 18, 2010

(30) Foreign Application Priority Data

Sep. 10, 2008 (DE) ..... 10 2008 041 951

(51) Int. Cl.
*G06G 7/48* (2006.01)

(52) U.S. Cl. ..... 703/6; 162/111; 428/221

(58) Field of Classification Search ..... 703/6; 34/306; 162/205, 111, 117, 101; 156/209; 428/154, 428/156, 221
See application file for complete search history.

(56) References Cited

U.S. PATENT DOCUMENTS

| | | | | |
|---|---|---|---|---|
| 5,624,532 | A * | 4/1997 | Trokhan et al. | 162/111 |
| 6,117,525 | A * | 9/2000 | Trokhan et al. | 428/154 |
| 7,670,669 | B2 * | 3/2010 | Lefvebvre Du Grosriez et al. | 428/156 |
| 2004/0055721 | A1 * | 3/2004 | Hilbig et al. | 162/117 |
| 2005/0067089 | A1 * | 3/2005 | Graff et al. | 156/209 |
| 2006/0076116 | A1 * | 4/2006 | Klerelid et al. | 162/111 |
| 2007/0074837 | A1 * | 4/2007 | Scherb et al. | 162/205 |
| 2007/0289159 | A1 * | 12/2007 | Thoroe-Scherb et al. | 34/306 |
| 2008/0047675 | A1 * | 2/2008 | Murray et al. | 162/101 |

FOREIGN PATENT DOCUMENTS

| | | |
|---|---|---|
| DE | 19632269 A1 | 2/1997 |
| DE | 19913926 A1 | 9/2000 |

OTHER PUBLICATIONS

Andrew J. Hanson; Rotations for N-Dimensional Graphics; Nov. 23, 2005; XP002558633; Internet URL.: http://www.cs.indiana.edu/pub/techreports/TR406.pdf.

* cited by examiner

*Primary Examiner* — Kandasamy Thangavelu
(74) *Attorney, Agent, or Firm* — Taylor IP, P.C.

(57) ABSTRACT

A method of surface topography prognosis for a tissue paper which is to be produced in a manufacturing process by utilizing a structured fabric and into which a structure is embossed by way of the fabric, the surface topography of at least one structured fabric which is already used in the production process is plotted by way of a sensor. Originating from the surface topography of the already utilized structured fabric, the surface topography of the tissue paper is simulated through data processing, through a simulation of the paper production process. The algorithm used for the simulation is calibrated with the aid of a comparison of the simulated surface topography of the tissue paper with the surface topography of the actual tissue paper produced with the structured fabric, which is already being utilized in the production process. Originating from the surface topography of a respective additional structured fabric the simulation of the surface topography of the tissue paper is subsequently conducted by utilizing the calibrated algorithm in order to provide a prognosis of the tissue paper's surface topography that can be expected.

16 Claims, 3 Drawing Sheets

METHOD TO PROVIDE A PROGNOSIS OF THE SURFACE TOPOGRAPHY OF TISSUE PAPER

BACKGROUND OF THE INVENTION

1. Field of the Invention

The invention relates to a method to provide a prognosis of the surface topography of tissue paper which is to be produced in a paper manufacturing process by utilizing a structured fabric and into which a structure is embossed by the fabric.

2. Description of the Related Art

Tissue papers are produced on structured fabrics, especially TAD fabrics (TAD=through air drying). The paper is drawn onto the fabric surface by an airflow, causing a texture to be embossed into the paper surface. With the appropriately structured surface of the fabric, a high suction capacity is achieved. The quality of tissue papers is characterized primarily by the respective suction capacity. A fundamental distinctive feature for the different qualities is however the respective surface characteristic, such as handling, feel, etc. Hitherto the effect of the respective structured fabric upon the surface of the tissue paper could only be established through practical testing, in other words through a test-production of tissue paper.

What is needed in the art is a method with which the surface topography of tissue paper which is to be produced in a manufacturing process by utilizing a structured fabric can be determined in advance, in a simple and efficient manner.

SUMMARY OF THE INVENTION

The present invention includes a method of surface topography prognosis for a tissue paper which is produced in a manufacturing process by utilizing a structured fabric and into which a structure is embossed by way of the fabric, the surface topography of at least one structured fabric which is already used in the production process is plotted from data received from a sensor. Originating from the surface topography of the structured fabric, the surface topography of the tissue paper is simulated through data processing, through a simulation of the paper production process. The algorithm used for the simulation is calibrated, with the aid of a comparison of the simulated surface topography of the tissue paper, with the surface topography of the actual tissue paper produced with the structured fabric which is already being utilized in the production process. Originating from the surface topography of a respective additional structured fabric the simulation of the surface topography of the tissue paper is subsequently conducted by utilizing the calibrated algorithm in order to provide a prognosis of the tissue paper's surface topography as to what can be expected.

Here the prognosis of the tissue paper's expected surface topography can occur originating from the surface topography or a real additional structured fabric which was plotted by a sensor, or, for example, also originating from the surface topography of a virtual fabric.

A precise prognosis of the tissue paper's surface appearance can herewith be provided without having to form tissue paper on actual fabrics, which are very expensive to produce. In addition, the development process is considerably accelerated with the utilizing of virtual fabrics.

According to one embodiment of the inventive method at least one virtual ball is rolled across the surface topography of the respective structured fabric during the data process generated simulation of the surface topography of the tissue paper whereby the resulting penetration depth of this virtual ball is determined (rolling ball method). A virtual surface, which is consistent with the surface of the tissue paper that is to be simulated, is then spread over the determined penetration depth.

For the comparison of the simulated surface topography of the tissue paper, with the surface topography of the tissue paper actually produced in the production process by the structured fabric it is also especially advantageous if the obtained data is subjected to a Fourier analysis and the surface roughness of both obtained images is determined.

The calibration of the algorithm used for the simulation occurs preferably, at least partially, over the diameter of the virtual ball. In principle the calibration can also occur through additional parameters that are to be optimized, other than through the diameter of the virtual ball. Preferably however, the calibration occurs, at least predominantly, through the diameter of the virtual ball.

During the data processing generated simulation of the surface topography of the tissue paper two, or more than two, virtual balls may be advantageously utilized, which would preferably be rolled behind each other on the surface topography of the respective structured fabric. The different virtual balls hereby possess, preferably at least partially, a different diameter.

By utilizing several virtual balls a more realistic representation is achieved. The utilization of two or more virtual balls produces two or more spread surface planes which are connected through a suitable combination to the resulting surface plane.

A suitable combination may, for example, be an averaging of (arithmetic, geometric), or also an averaging with a higher weighting of one or the other surface plane.

In calibrating the algorithm used for the simulation, boundary conditions in the paper manufacturing process are especially considered. The considered boundary conditions in the paper manufacturing process include, in particular, boundary conditions of the tissue machine in question, as well as characteristics of the initial tissue paper which has not yet been provided with the referred to structure.

The considered boundary conditions of the respective tissue machine may, for example, include the produced vacuum and/or airflow through which the tissue paper is drawn onto the surface of the structured fabric during the embossing of the structure.

The considered boundary conditions of the initial tissue paper, which has not yet been provided with the referred to structure, can for example, include its flexural strength.

An additional characteristic can include the shrinkage of the tissue paper, or the crepe that is experienced by such a tissue paper during the production in some applications. This is between 2-5% shrinkage and up to 30% crepe. In order to adjust this parameter a crepe parameter can be set in the software which thrusts the surface plane, resulting from the rolling ball algorithm, in one direction.

By plotting the topography of the structured or respectively of tissue fabrics and the simulation of the paper manufacturing process by the algorithm it is possible to provide a prognosis of the surface of the tissue paper as to what may be expected. Including but not limited to, the inventive method supports marketing/sales and allows a targeted selection of fabrics, in order to achieve a certain surface structure of the tissue paper, which is to be produced.

In order to calibrate the algorithm to the condition of a particular tissue machine, the topographies of the fabrics and tissue paper provided by a customer can be plotted, for example, by a surface scanner. The algorithm may be based in particular on the method known as the "rolling ball" method in informational theory. As already mentioned a virtual ball is rolled over the topography of a surface, in this case the surface topography of a structured tissue-fabric. A surface is spread over the penetration depth of the virtual ball. This is consistent with the surface topography of the tissue paper produced on this surface. The decisive parameter, which is to be optimized is the diameter of the virtual ball. This parameter includes the conditions in the paper or tissue machine, for example vacuum, airflow, etc, and the characteristics of the initial tissue paper, for example, its flexural strength. For a more realistic presentation two, or more than two, "rolling balls" or virtual balls with different diameters, which are located one after another, can be utilized.

If the surface topography of the actual tissue paper coincides well with the surface topography of the tissue paper obtained by simulation, then the herewith obtained parameters may be utilized for further simulation. The algorithm is herewith calibrated to the boundary conditions in the tissue machine and to the characteristics of the initial tissue paper.

The additional simulation may, for example, occur based on the surface topographies of actual 3D-scanned fabric surfaces. However, as already mentioned, generated, or in other words virtual fabric surfaces may also be used.

In order to optimize the parameters, design of experiments (DoE) methods can be used. Based on a standard value for the diameter of the virtual ball, various simulations may be conducted with one, or for example, with two virtual balls. For this the diameter is systematically altered until the optimum consistency is attained.

Basically, utilization of other optimization processes such as genetic algorithms and target oriented approaches are contemplated.

Subject matter of the invention includes a computer program with program code to implement the method described above, if the program is carried out on a computer or on an appropriate calculator.

The subject matter of the invention is also a computer program product with program code stored on a computer readable data storage medium in order to implement the method described above. The inventive computer program, as well as the inventive computer program product relate preferably to all characteristics of the inventive method which can be influenced by program code means and/or can be realized through data processing.

Another subject of the present invention is also an apparatus to provide a prognosis of the surface topography of the tissue paper which is to be produced in a paper manufacturing process by utilizing a structured fabric and into which a structure is embossed by way of the fabric, including a sensor to plot the surface topography of the produced tissue paper and to plot the surface topography of a respective structured fabric, as well as including a data processing unit, which is configured for implementation of the previously described method.

The sensor preferably comprises a 3D-surface scanner.

The invention can be used especially advantageously for a prognosis in the area of the forming fabrics, preferably with reference to the surface roughness, marking and/or similar characteristics.

BRIEF DESCRIPTION OF THE DRAWINGS

The above-mentioned and other features and advantages of this invention, and the manner of attaining them, will become more apparent and the invention will be better understood by reference to the following description of an embodiments of the invention taken in conjunction with the accompanying drawings, wherein.

The invention is described below in further detail with reference to design examples and drawings.

Corresponding reference characters indicate corresponding parts throughout the several views. The exemplification set out herein illustrates one embodiment of the invention (, in one form,) and such exemplification is not to be construed as limiting the scope of the invention in any manner.

DETAILED DESCRIPTION OF THE INVENTION

Figure 1:
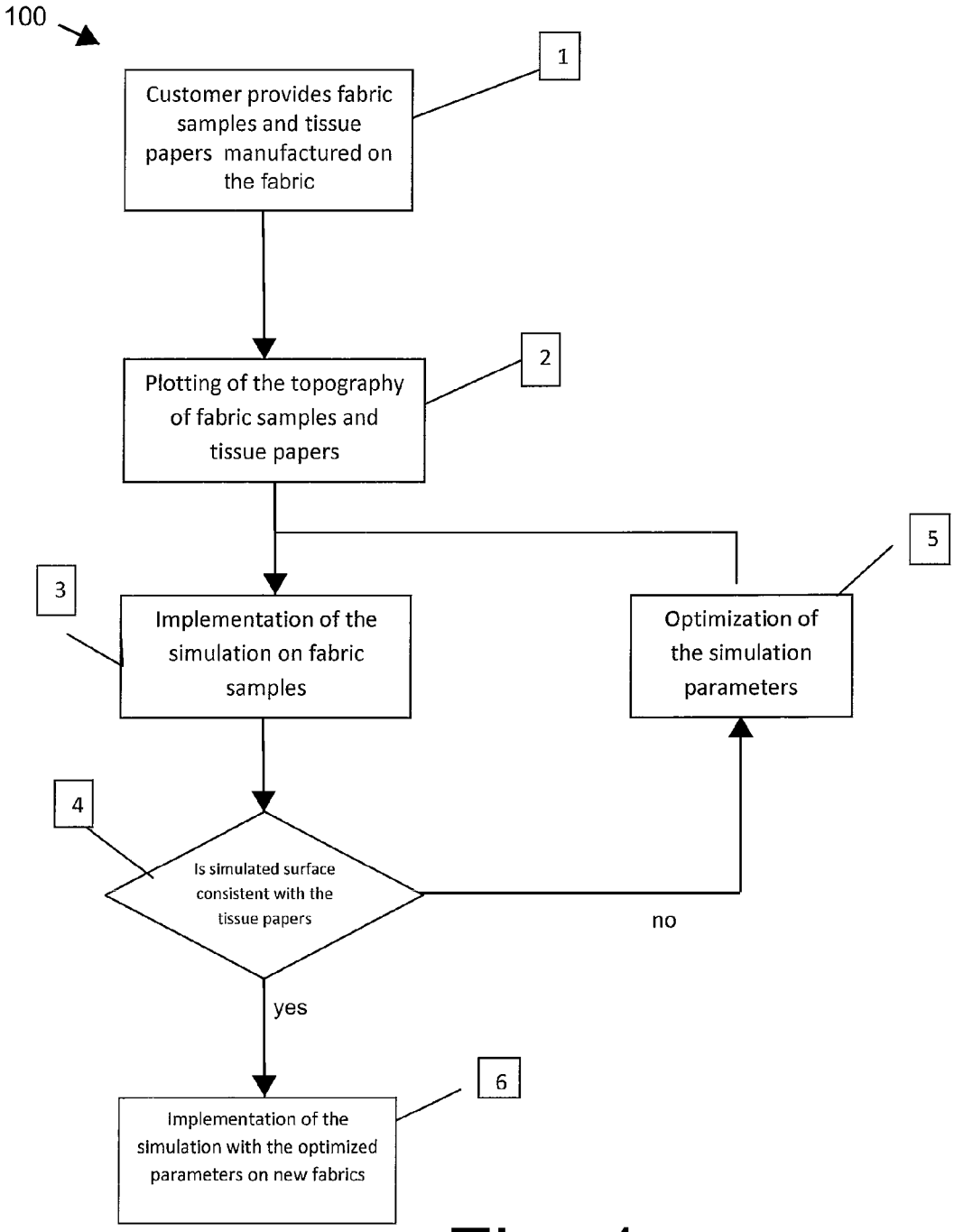
FIG. 1 is a flow chart of an exemplary embodiment of the present inventive method.

Referring now to the drawings, and more particularly to FIG. 1, there is shown a flow chart of an embodiment of the present inventive method 100.

Method 100 facilitates the prognosis of the surface topography of a tissue paper, which is to be produced in a manufacturing process by utilizing a structured fabric and into which a structure is embossed by way of the fabric.

For this purpose the surface topography of at least one structured fabric, which is already being used in the manufacturing process is plotted by way of a sensor. Originating from the surface topography of the already utilized structured fabric, the surface topography of the tissue paper is simulated through data processing, through a simulation of the paper production process. The algorithm used for the simulation is calibrated with the aid of a comparison of the simulated surface topography of the tissue paper with the surface topography of the actual tissue paper produced with the structured fabric, which is already being utilized in the production process. Originating from the surface topography of a respective additional structured fabric, the simulation of the surface topography of the tissue paper is subsequently conducted by utilizing the calibrated algorithm in order to predict the tissue paper's surface topography, and what can be expected.

In the exemplary design form of inventive method 100 resulting from the flow chart of FIG. 1 the customer provides fabric samples and tissue papers which were manufactured on them (step 1). The tissue papers were produced, for example, in a paper or tissue machine that was utilized by the customer.

The respective surface topographies are plotted by the use of a surface scanner from the fabric samples and tissue papers provided by the customer (step 2).

Based on the surface topography of the fabric samples provided by the customer the surface topographies of the tissue paper are simulated through a respective simulation of the paper manufacturing process. (step 3). Subsequently the simulated surface topographies are compared with the plotted surface topographies of the tissue papers which were provided by the customer (step 4). If the surface topographies do not coincide the simulation parameters are optimized in step 5. Subsequently the simulation occurs again, originating from the fabric samples provided by the customer (step 3). If the result of the comparison conducted in step 4 is that the simulated surface topographies substantially coincide with the surface topographies of the tissue papers which were provided by the customer, then the simulation can be carried out with the optimized parameters on new fabrics (step 6).

The carried out comparison, as well as the optimization of the simulation parameters, serves to calibrate the algorithm that is used for the simulation to the conditions of the paper manufacturing process, and especially to the conditions of the tissue machine utilized by the customer and the characteristics of the initial tissue paper.

The algorithm can be based on a method known in informational technology as the "rolling ball" method. Hereby a virtual ball is rolled over the surface topography, in this case the surface topography of the structured tissue fabric. A surface is spread over the penetration depth of the virtual ball. This corresponds with the surface topography of the tissue paper produced on this spread surface. The decisive parameter that is to be optimized is the diameter of the virtual ball. This parameter can also include the conditions in the paper or tissue machine, for example vacuum, airflow, etc, and the characteristics of the initial tissue paper, for example its flexural strength. For a more realistic presentation two, or more than two, "rolling balls" or virtual balls with different diameters, which are located one after another, can be utilized.

If the surface topography of the actual tissue paper coincides well with the surface topography of the tissue paper obtained by simulation, then the obtained parameters may be utilized for further simulation. The algorithm is calibrated to the boundary conditions in the tissue machine and to the characteristics of the initial tissue paper. The additional simulation may, for example, occur based on the surface topographies of actual 3D-scanned fabric surfaces. However, as already mentioned, a generated, or in other words a virtual fabric surface may also be used.

A precise prognosis of the tissue paper's surface appearance can now be provided herewith out having to produce tissue paper on actual fabrics which are very expensive to produce. In addition, the development process is considerably accelerated with the possibility of utilizing virtual fabrics.

Figure 2:
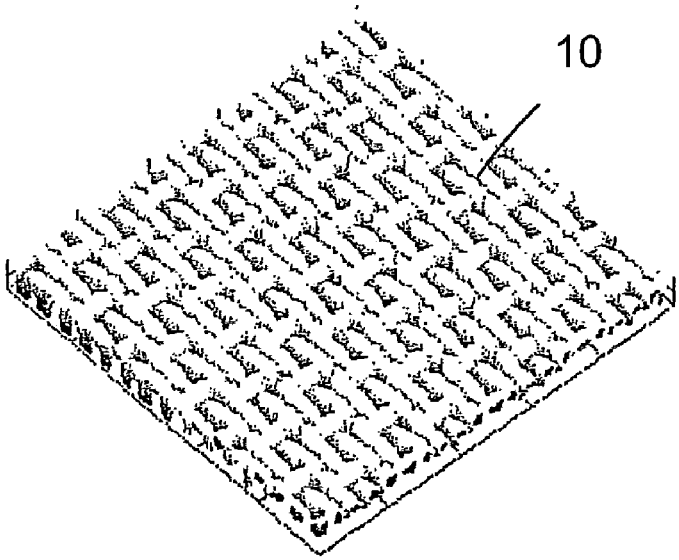
FIG. 2 is the surface topography of a structured fabric used in the production of tissue paper, plotted with a 3D-surface scanner.
Figure 3:
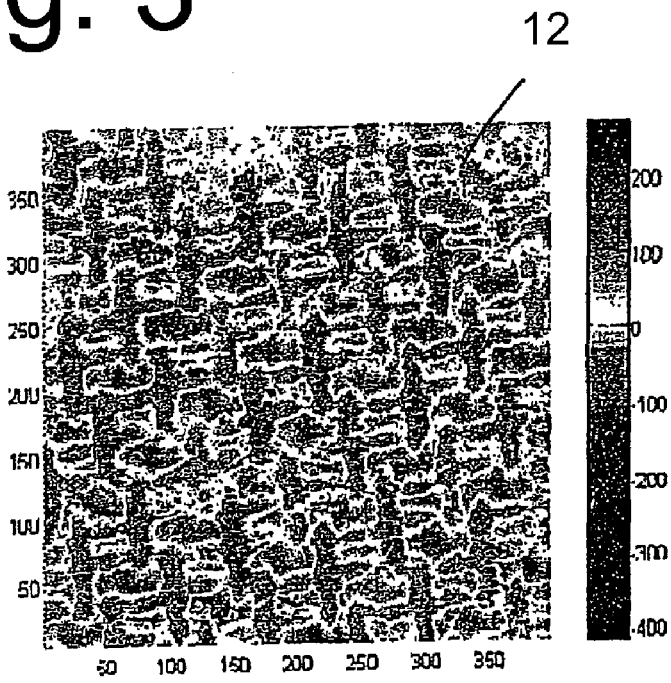
FIG. 3 is the actual surface of the tissue paper and FIG. 4 is the simulated surface topography of the tissue paper.

Now, additionally referring to FIG. 2 there is illustrated the surface topography 10 of a structured fabric for the production of tissue paper which was plotted with a 3D surface scanner. In the existing example the plot was produced, for example, by way of a nano-focus μscan. FIG. 3 illustrates an actual surface or surface topography 12 of the tissue paper.

Figure 4:
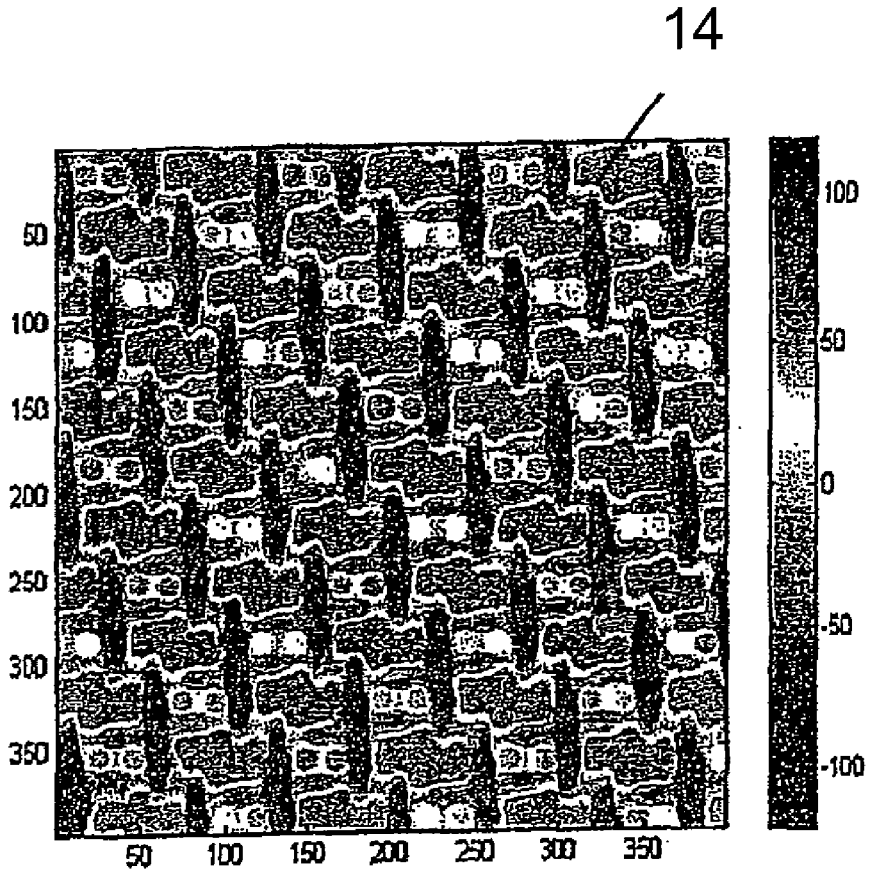

FIG. 4 illustrates the simulated surface topography 14 of the tissue paper originating from the plotted surface topography 10 of a structured fabric according to FIG. 2.

The simulated surface topography according to FIG. 4 is the result of the simulation by the "rolling ball" algorithm. In the existing design example 1 mm was selected for the parameter determined by the diameter of the virtual ball. The edge length of the depictions in the drawings is always 1 cm.

The "1 mm" value for the parameter determined by the diameter of the virtual ball was obtained by comparison of the simulated image with the actual image according to FIG. 3. The comparison evaluation was conducted through a Fourier analysis and through a valuation of the surface roughness of both images.

In the existing design example the scale of the two images, according to FIGS. 3 and 4, in each case, corresponds to 400 pixel, with the pixel spacing representing 2.5 μm.

DoE-methods can be used for optimization of the parameters. Originating from a standard value of, in this case, for example, 1.3 mm for the diameter of the virtual ball, various simulations may be conducted with one or at least two virtual balls. The diameter in the existing example was changed systematically by 0.3 or respectively 0.6 mm. The best concurrence was obtained by 1.0 mm.

Basically, utilization of other optimization processes such as, for example, genetic algorithms is possible and target oriented.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

Reference Identification

| | |
|---|---|
| 10 | plotted surface topography of a structured fabric |
| 12 | actual surface topography of an actual tissue paper |
| 14 | simulated surface topography of a tissue paper |
| 100 | method of the present invention |

What is claimed is:

1. A method to provide a prognosis of a surface topography for a tissue paper which is to be produced in a paper manufacturing process by utilizing a specified structured fabric and into which a structure is embossed by the fabric, the method comprising the steps of:

plotting a surface topography of at least one structured fabric which is already utilized in a paper production process, whereby sensor data originating from the surface topography of the already utilized structured fabric is used in the plotting;

simulating a surface topography of a simulated tissue paper through data processing by a simulation of the paper production process using the plotted surface topography of the structured fabric;

calibrating an algorithm used for the simulation step including a comparison of the simulated surface topography of the simulated tissue paper with a surface topography of an actual tissue paper produced with the structured fabric which is already being utilized in the paper production process; and simulating a surface topography of the tissue paper which is to be produced using a surface topography of the specified structured fabric by utilizing the calibrated algorithm in order to provide the prognosis of the surface topography of the tissue paper which is to be produced.

2. The method of claim 1, wherein at least one virtual ball is rolled over the plotted surface topography of the structured fabric during the simulation of the surface topography of the simulated tissue paper whereby a resulting penetration depth of this virtual ball is determined by a rolling ball method and that a virtual surface which is consistent with the surface topography of the simulated tissue paper is then spread over the determined penetration depth.

3. The method of claim 2, wherein the comparison of the simulated surface topography of the simulated tissue paper with the surface topography of the actual tissue paper produced in the paper production process with the structured fabric which is already being utilized comprises the simulation data and actual data being subjected to a Fourier analysis and the surface roughness of both the simulated surface topography and the surface topography of the actual tissue paper produced being determined.

4. The method of claim 2, wherein the calibrating the algorithm step used for the simulation process occurs at least partially over a diameter of the at least one virtual ball.

5. The method of claim 4, wherein the calibrating of the algorithm step used for the simulation process occurs at least predominantly through the diameter of the at least one virtual ball.

6. The method of claim 5, wherein said at least one virtual ball is at least two virtual balls, and during the data processing generated in said simulating the surface topography of the simulated tissue paper, said at least two virtual balls are utilized which are rolled one behind the other on the plotted surface topography of the structured fabric.

7. The method of claim 6, wherein said at least two virtual balls have differing diameters.

8. The method of claim 7, wherein said calibrating the algorithm used for the simulation step includes considering boundary conditions in the paper manufacturing process.

9. The method of claim 8, wherein the considered boundary conditions of the paper manufacturing process include boundary conditions of a tissue machine used, as well as characteristics of the tissue paper before it is provided with a surface topography by the structured fabric.

10. The method of claim 9, wherein the considered boundary conditions of the tissue machine include at least one of produced vacuum and airflow through which the tissue paper is drawn onto a surface of the structured fabric during an embossing of the tissue paper.

11. The method of claim 9, wherein the considered boundary conditions include a flexural strength of the tissue paper before being provided with the surface topography.

12. The method of claim 1, wherein the method is implemented using a computer program on a program code means, the computer program being executed on one of a computer and a calculator.

13. The method of claim 12, wherein the computer program is stored on a computer readable data storage medium.

14. An apparatus to provide a prognosis of a surface topography of a tissue paper which is to be produced in a paper manufacturing process by utilizing a specified structured fabric and into which a structure is embossed by the structured fabric, comprising:

a sensor configured to provide data that is used to plot a surface topography of a produced tissue paper and to plot a surface topography of a structured fabric which is already utilized in a paper production process; and a data processing unit which is configured to implement a method, the method including the steps of:

plotting a surface topography of at least one structured fabric which is already utilized in a paper production process, whereby sensor data originating from the surface topography of the already utilized structured fabric is used in the plotting;

simulating a surface topography of a simulated tissue paper through data processing by a simulation of the paper production process using the plotted surface topography of the structured fabric;

calibrating an algorithm used for the simulation step including a comparison of the simulated surface topography of the simulated tissue paper with a surface topography of an actual tissue paper produced with the structured fabric which is already being utilized in the paper production process; and simulating of a surface topography of the tissue paper which is to be produced using a surface topography of the specified structured fabric by utilizing the calibrated algorithm in order to provide the prognosis of the surface topography of the tissue paper which is to be produced.

15. The apparatus of claim 14, wherein said sensor is a 3D-surface scanner.

16. The apparatus of claim 14, wherein the method is implemented as a computer program to provide a prognosis of forming fabrics relating to at least one of surface roughness and surface marking.

* * * * *

UNITED STATES PATENT AND TRADEMARK OFFICE

CERTIFICATE OF CORRECTION

PATENT NO. : 8,260,592 B2
APPLICATION NO. : 12/556641
DATED : September 4, 2012
INVENTOR(S) : Matthias Schmitt et al.

It is certified that error appears in the above-identified patent and that said Letters Patent is hereby corrected as shown below:

In the Specification

COLUMN 5 line 32, delete “herewith out having”, and replace therefore --herewith without having--.

Signed and Sealed this
First Day of October, 2013

Teresa Stanek Rea
*Deputy Director of the United States Patent and Trademark Office*